US011920802B2

(12) United States Patent
Robinson, III et al.

(10) Patent No.: US 11,920,802 B2
(45) Date of Patent: Mar. 5, 2024

(54) AIR CONDITIONER UNITS AND HEATING ELEMENTS THEREOF

(71) Applicant: Haier US Appliance Solutions, Inc., Wilmington, DE (US)

(72) Inventors: Charles D. Robinson, III, Louisville, KY (US); Joshua Duane Longenecker, Louisville, KY (US); Richard Dustin Henderson, La Grange, KY (US); Bryan Isaac D'Souza, Louisville, KY (US); Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/882,873

(22) Filed: Aug. 8, 2022

(65) Prior Publication Data

US 2024/0044524 A1 Feb. 8, 2024

(51) Int. Cl.
*F24F 1/0067* (2019.01)
*F24F 1/0063* (2019.01)
*F24F 1/0375* (2019.01)

(52) U.S. Cl.
CPC ..... *F24F 1/0067* (2019.02); *F24F 1/0063* (2019.02); *F24F 1/0375* (2019.02)

(58) Field of Classification Search
CPC ..... F24F 1/0063; F24F 1/0067; F24F 1/0007; F24F 1/009; F24F 1/0093; F24F 1/0373; F24F 1/0375; F24F 2221/34
See application file for complete search history.

(56) References Cited

U.S. PATENT DOCUMENTS

| | | | | |
|---|---|---|---|---|
| 3,411,569 | A * | 11/1968 | Hildreth | F24F 1/0373 62/263 |
| 4,693,089 | A * | 9/1987 | Bourne | F24D 11/0214 62/238.7 |
| 6,658,882 | B2 | 12/2003 | Ohama et al. | |
| 9,877,526 | B2 * | 1/2018 | Haas | B41J 2/375 |
| 10,520,213 | B2 | 12/2019 | D'Souza et al. | |
| 2009/0056929 | A1 * | 3/2009 | Mulder | F24H 9/2071 700/275 |
| 2015/0219386 | A1 * | 8/2015 | Zinger | F24F 1/0063 29/890.035 |

FOREIGN PATENT DOCUMENTS

JP 4697470 B2 6/2011

* cited by examiner

*Primary Examiner* — Joseph F Trpisovsky
(74) *Attorney, Agent, or Firm* — Dority & Manning, P.A.

(57) ABSTRACT

An air conditioner unit includes an indoor heat exchanger assembly positioned in an indoor portion of the air conditioner unit. The indoor heat exchanger assembly includes an indoor heat exchanger and an indoor fan. The air conditioner unit also includes a heating unit. The heating unit may be positioned in the indoor portion of the air conditioner unit downstream of the indoor fan and/or at the exhaust side of the indoor fan.

20 Claims, 8 Drawing Sheets

AIR CONDITIONER UNITS AND HEATING ELEMENTS THEREOF

FIELD OF THE INVENTION

The present disclosure relates generally to air conditioner units, and more particularly to heating elements for air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. A typical such air conditioner unit includes an indoor portion and an outdoor portion. The indoor portion is generally located indoors, and the outdoor portion is generally located outdoors. Accordingly, the air conditioner unit generally extends through a wall, window, etc. of the structure.

In the outdoor portion of a conventional air conditioner unit, a compressor that operates a refrigerating cycle is provided. At the back of the outdoor portion, an outdoor heat exchanger connected to the compressor is disposed, and facing the outdoor heat exchanger, an outdoor fan for urging air across the outdoor heat exchanger is provided. At the front of the indoor portion of a conventional air conditioner unit, an air inlet is provided, and above the air inlet, an air outlet is provided. A blower fan and a heating unit are additionally provided in the indoor portion. Between the blower fan and heating unit and the air inlet, an indoor heat exchanger connected to the compressor is provided.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the heating unit is operated to raise the temperature of air in the air passage. The air, having had its temperature raised, is blown out through the air outlet into the room to heat the room.

In many currently known air conditioner units, the heating unit is formed from a plurality of heater banks. Such heater banks are relatively bulky and occupy a significant percentage of the volume within the indoor portion of the air conditioner unit. Such heater banks are typically positioned upstream of the indoor blower fan, such as between the indoor inlet and the indoor blower fan, in the indoor portion of the air conditioner unit. This positioning also places the heater banks adjacent to the indoor heat exchanger and downstream of the indoor heat exchanger. As a result, uniform mixing of air may be impaired and placement of thermal safety devices may be difficult due to the small remaining space between and around the heater banks and the indoor heat exchanger.

Accordingly, improved heating units for air conditioner units are desired in the art. In particular, heating units which are less obtrusive and which can be placed in various locations within the air conditioner unit would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, an air conditioner unit is provided. The air conditioner unit includes an indoor heat exchanger assembly positioned in an indoor portion of the air conditioner unit. The indoor heat exchanger assembly includes an indoor heat exchanger and an indoor fan. The air conditioner unit also includes a strip heating element positioned in the indoor portion of the air conditioner unit downstream of the indoor fan.

In accordance with another embodiment, an air conditioner unit is provided. The air conditioner unit includes an indoor heat exchanger assembly positioned in an indoor portion of the air conditioner unit. The indoor heat exchanger assembly includes an indoor heat exchanger and an indoor fan. The air conditioner unit also includes a heating element positioned in the indoor portion of the air conditioner unit at the exhaust side of the indoor fan.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
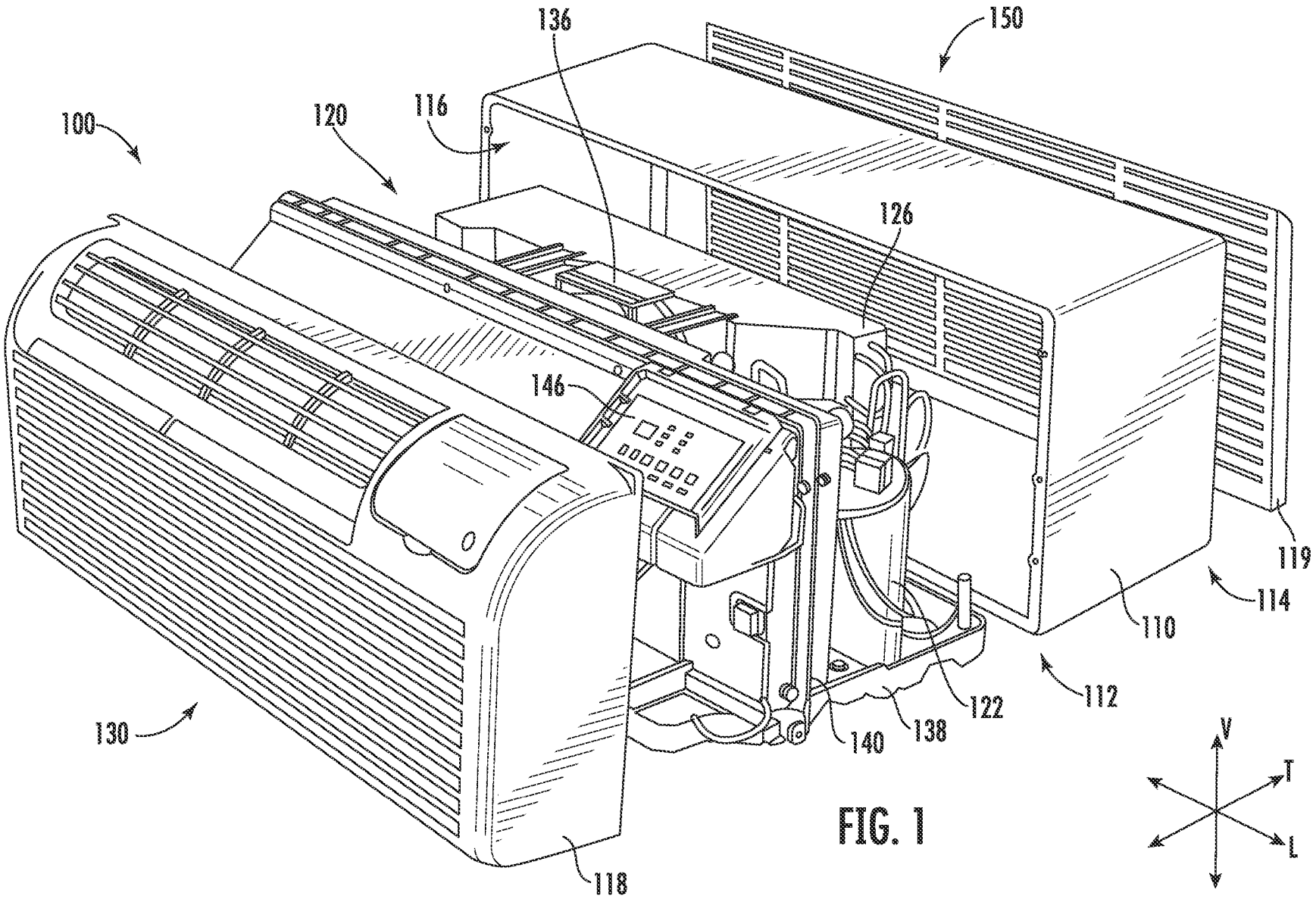
FIG. 1 provides an exploded perspective view of an exemplary air conditioner unit which may incorporate a heating unit in accordance with one or more embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

The terms "upstream" and "downstream" refer to the relative direction with respect to fluid flow in a fluid pathway. For example, "upstream" refers to the direction from which the fluid flows, and "downstream" refers to the direction to which the fluid flows.

Figure 2:
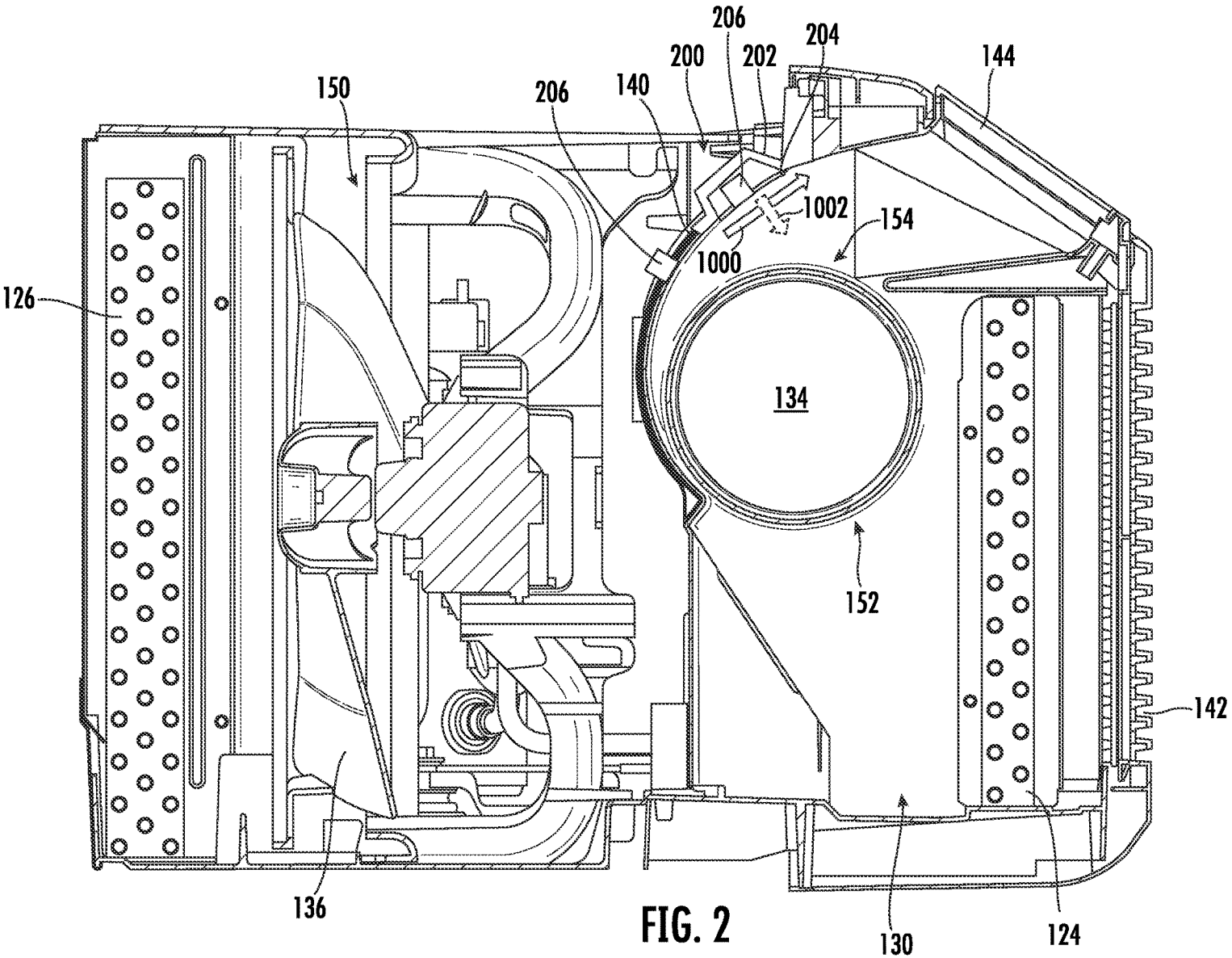
FIG. 2 provides a section view of the air conditioner unit of FIG. 1 including a heating unit in accordance with one or more exemplary embodiments of the present disclosure.

Referring now to FIGS. 1 and 2, an exemplary air conditioner unit 100 is illustrated. The air conditioner unit 100 is a one-unit type air conditioner, also conventionally referred to as a room air conditioner. The unit 100 includes an indoor portion 130 and an outdoor portion 150, and generally defines a vertical direction V, a lateral direction L, and a transverse direction T. The vertical direction V, the lateral direction L, and the transverse direction T are mutually perpendicular to each other, such that an orthogonal coordinate system is generally defined.

Air conditioner unit 100 is operable to generate chilled and/or heated air in order to regulate the temperature of an associated room or building. As may be seen in FIG. 1, air conditioner unit 100 includes a casing 110 extends between an interior side portion 112 and an exterior side portion 114. Interior side portion 112 of casing 110 and exterior side portion 114 of casing 110 are spaced apart from each other along the lateral direction L. Thus, interior side portion 112 of casing 110 may be positioned at or contiguous with an interior atmosphere, and exterior side portion 114 of casing 110 may be positioned at or contiguous with an exterior atmosphere. The air conditioner unit 100 also includes components for circulating air such as an outdoor fan 136 in the outdoor portion 150 and an indoor blower fan 134 (hereinafter, "indoor fan 134," such as may be seen in FIG. 2) in the indoor portion 130. Sealed system 120 includes components for transferring heat between the exterior atmosphere and the interior atmosphere. For example, sealed system 120 includes a compressor 122, an interior heat exchanger or coil 124 and an exterior heat exchanger or coil 126.

Casing 110 defines a mechanical compartment 116. Sealed system 120 is disposed or positioned within mechanical compartment 116 of casing 110. The sealed system 120 may be attached to the casing 110, e.g., with mechanical fasteners such as screws. A front panel 118 is attached to the sealed system 120, e.g., with a snap fit or interference fit, and a rear grill or screen 119 is mounted to casing 110. The front panel 118 and the rear grill 119 hinder or limit access to mechanical compartment 116 of casing 110. Front panel 118 is mounted to sealed system 120 such that the front panel 118 is positioned at interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110. As may be seen, e.g., in FIG. 2, an indoor inlet 142 and an indoor outlet 144 are defined in the front panel 118, with the indoor fan 134 positioned therebetween, such that the indoor fan 134 urges air into the air conditioner unit 100 from the conditioned space through the indoor inlet 142 and returns air to the conditioned space from the air conditioner unit through the indoor outlet 144.

Air conditioner unit 100 also includes a drain pan or bottom tray 138 and a bulkhead assembly 140 positioned within mechanical compartment 116 of casing 110. Sealed system 120 is positioned on bottom tray 138. Thus, liquid runoff from sealed system 120 may flow into and collect within bottom tray 138. Bulkhead assembly 140 may be mounted to bottom tray 138 and extend upwardly from bottom tray 138 to a top wall of casing 110. Bulkhead assembly 140 limits or prevents air flow between interior side portion 112 of casing 110 and exterior side portion 114 of casing 110 within mechanical compartment 116 of casing 110. Thus, bulkhead assembly 140 may divide mechanical compartment 116 of casing 110.

Air conditioner unit 100 further includes a controller 146 with user inputs, such as buttons, switches and/or dials. Controller 146 regulates operation of the air conditioner unit 100. Thus, controller 146 is in operative communication with various components of air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Referring now to FIG. 2 in particular, in some embodiments, the air conditioning unit may include a heating unit 200. The heating unit 200 may be positioned downstream of the indoor fan 134. The heating unit 200 may be positioned at the exhaust side of the indoor fan 134. As noted in FIG. 2, the heating unit 200 may be downstream of the indoor fan 134 with respect to a flow of air 1000 from the indoor fan 134 to the indoor outlet 144. Also as may be seen in FIG. 2, the indoor fan 134 may define an intake side or a suction side 152, e.g., proximate and/or facing the indoor inlet 142, and an exhaust side 154 generally opposite the suction side 152, e.g., proximate and/or facing the indoor outlet 144. Thus, the heating unit 200 may be positioned at the exhaust side 154 of the indoor fan 134, e.g., when the heating unit 200 is between the indoor fan 134 and the indoor outlet 144, and/or when the heating unit 200 is closer to the exhaust side 154 than to the suction side 152.

As may be seen in FIG. 2, the heating unit 200 may include a frame 202 and one or more heating elements 204 mounted in the frame 202. In some embodiments, the frame 202 may be a single piece which is generally coextensive with the heating element(s) 204 in at least one dimension, such as in two dimensions, e.g., length and width, or the frame 202 may include multiple pieces spaced along, e.g., the length of, the heating element(s) 204. In additional embodiments, the heating element(s) 204 may be supported by a single-piece frame 202 on only one end of the heating element(s) 204 or in the middle of the heating element(s) 204. The heating element(s) 204 may be positioned and configured to define a heat flux direction 1002, as noted in FIG. 2.

In some embodiments, a thermal cutout 206 or other thermal limiting device may be included in or next to the heating unit 200. The thermal cutout 206 may be a resettable cutout or a one-shot thermal cutout. The thermal cutout 206 may be in thermal communication with the heating unit 200. In such embodiments, the thermal cutout 206 may be configured to deactivate the heating unit 200 when a temperature at the thermal cutout 206 exceeds a threshold. For example, the thermal cutout 206 may disconnect or open an electrical circuit connected to the heating unit 200 when the temperature at the thermal cutout 206 exceeds the threshold, thereby deactivating the heating unit 200. For example, the threshold may be about 160° F. Two thermal cutouts 206 are illustrated in FIG. 2 by way of example to show potential locations for the cutout 206. In some embodiments, only a single cutout 206 may be provided, such as in one of the two locations illustrated in FIG. 2, or in another similar location, e.g., sufficiently close to the heating unit 200 to detect a potential overheat of the heating unit. Additionally, in some embodiments, the threshold temperature of the cutout 206 may be varied in proportion to the distance between the cutout 206 and the heating unit 200, such as a lower threshold when the cutout 206 is farther from the heating unit. In some embodiments, more than one cutout 206 may be included, such as to provide redundancy and/or multiple temperature thresholds.

Also as may be seen in FIG. 2, in some embodiments, the heating unit 200 may be the only heating unit in the indoor portion of the air conditioner unit 100 and there may be no other heating elements, other than the one or more heating elements of the heating unit 200, in the indoor portion of the air conditioner unit 100. In some embodiments, the air conditioner unit 100 may include no heating units or heating elements upstream of the indoor fan 134 or on the suction side 152 of the indoor fan 134. In some embodiments, the air conditioner unit 100 may include no rod heaters, e.g., no rod resistance heating elements.

Figure 3:
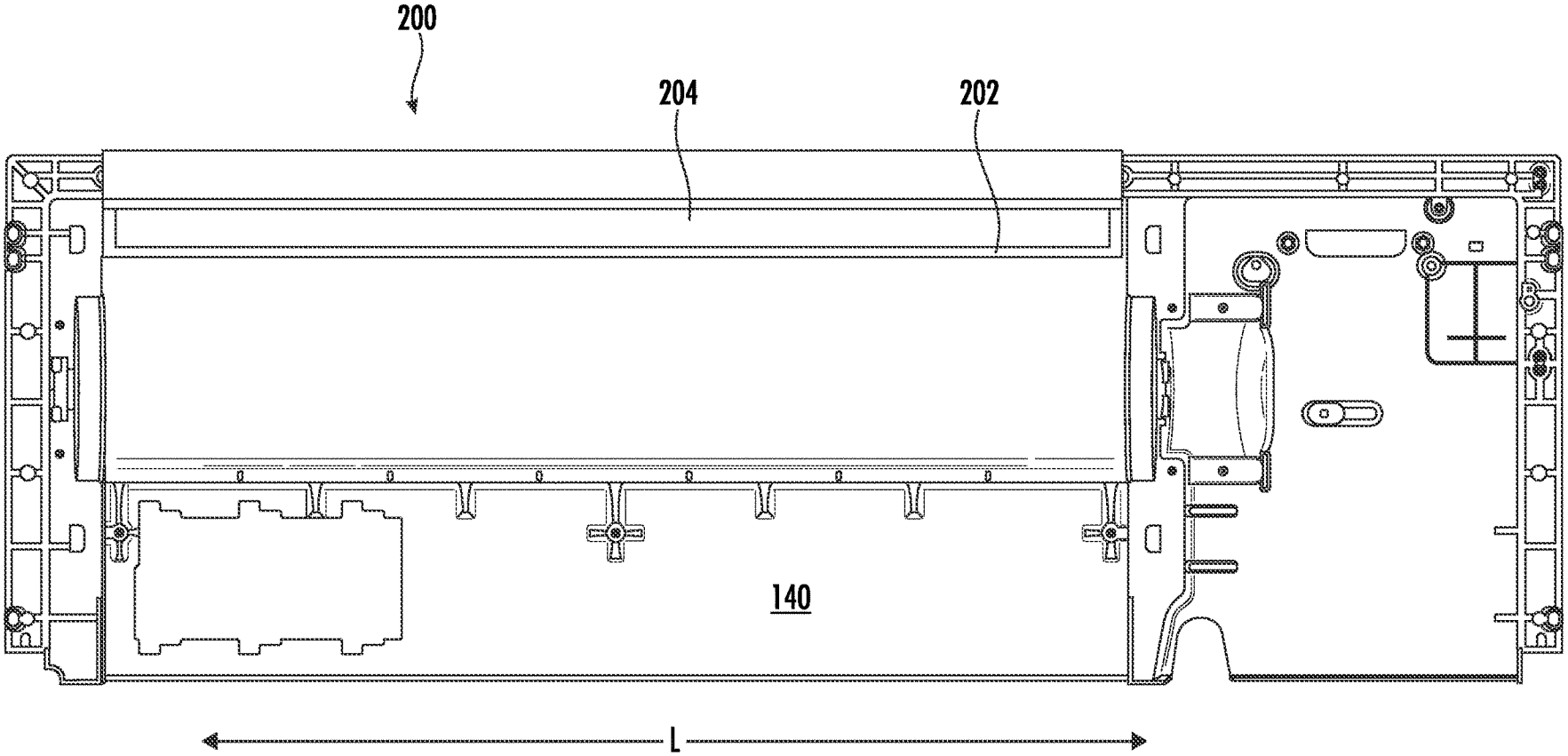
FIG. 3 provides a front view of a bulkhead and heating unit of the air conditioner unit of FIG. 1
Figure 4:
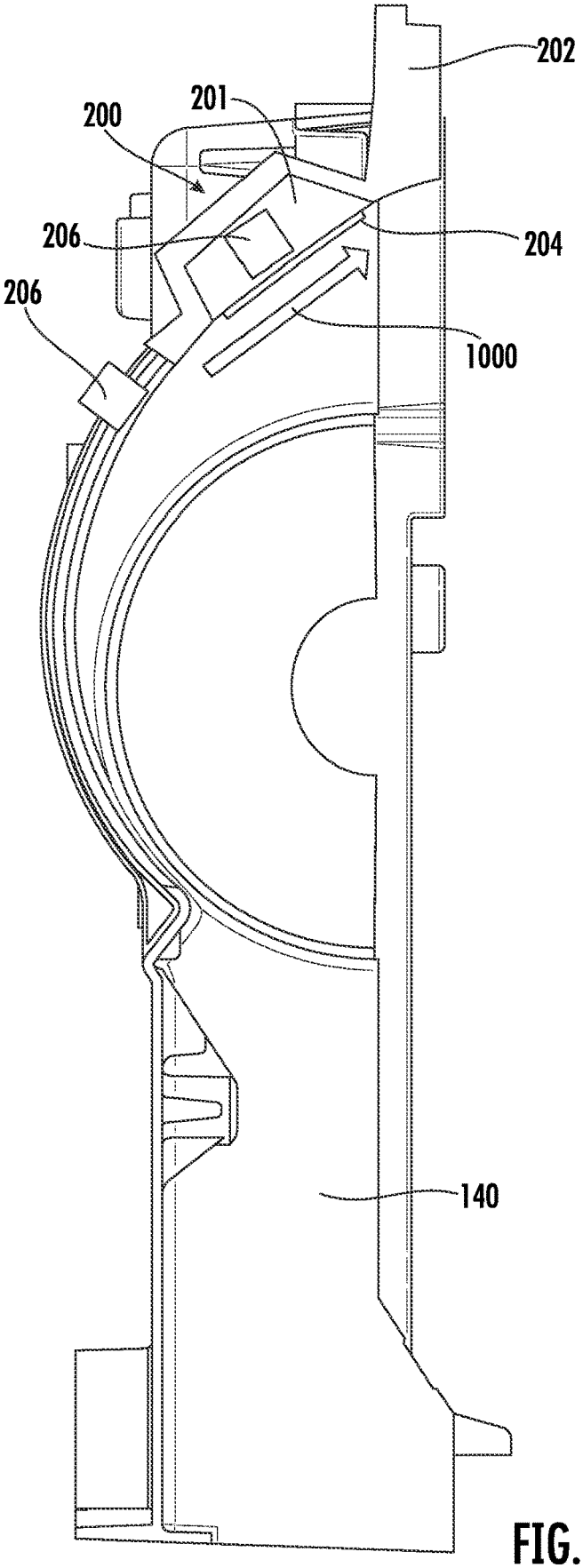
FIG. 4 provides a section view of the bulkhead and heating unit of FIG. 3.

Referring now specifically to FIGS. 2 through 4, in some embodiments, the heating unit 200 may be mounted to the bulkhead 140 between the indoor portion 130 and the outdoor portion 150, with the heating element(s) 204 thereof facing the indoor portion 130 of the air conditioner unit 100, e.g., such that the heat flux 1002 (FIG. 2) is towards or into the indoor portion 130. In some embodiments, e.g., as best seen in FIG. 3, the heating unit 200 may be generally coextensive with the indoor fan 134, e.g., along the lateral direction L. The heating unit 200 may be formed as an insert in the bulkhead 140, e.g., whereby the heating unit 200 fits within the bulkhead 140 and limits or prevents air flow between the indoor portion 130 and the outdoor portion 150. For example, the frame 202 may fit snugly within the bulkhead 140 in an air-tight or generally air-tight manner.

Figure 5:
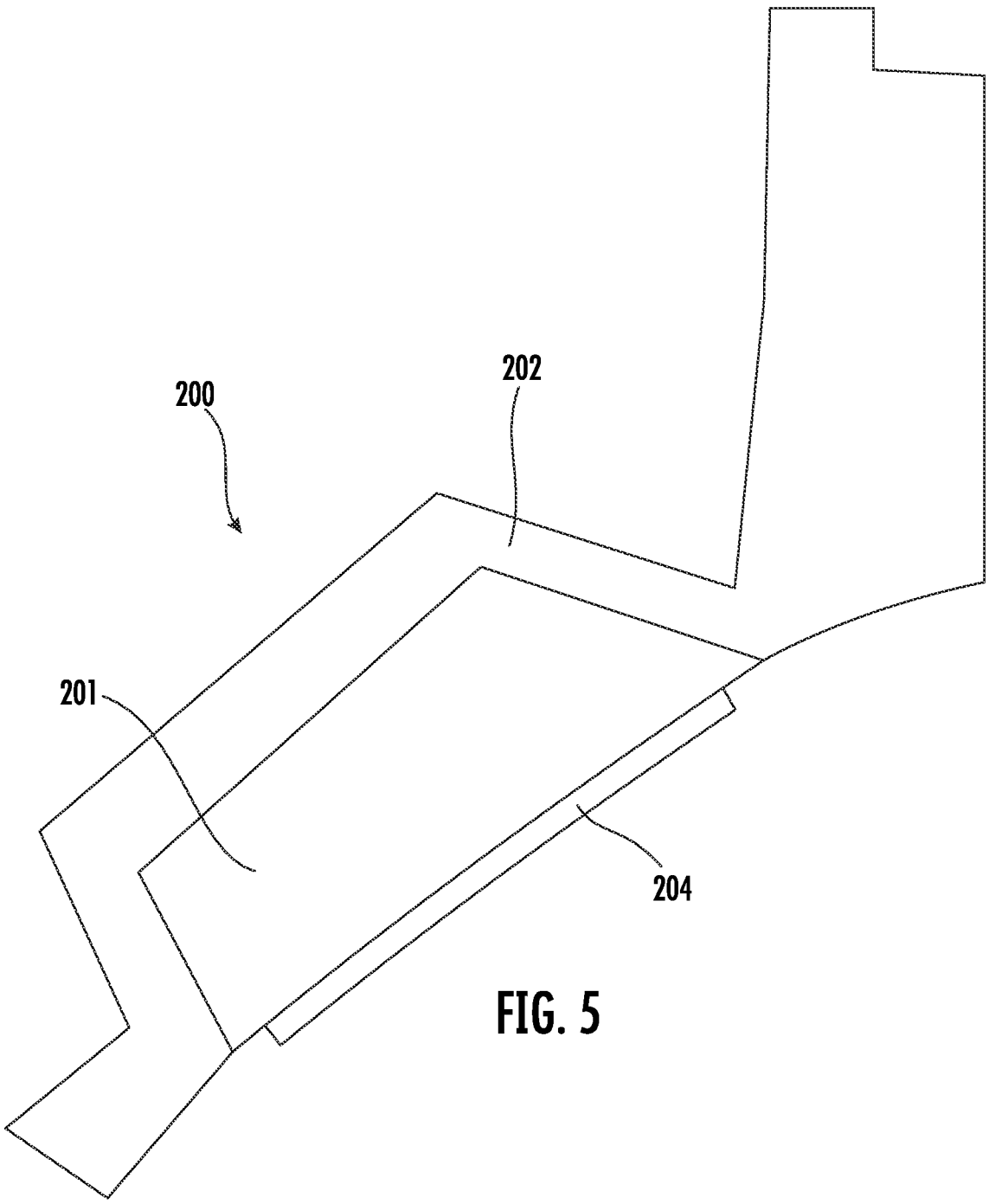
FIG. 5 provides a section view of a heating unit in accordance with one or more embodiments of the present disclosure.

In some embodiments, e.g., as illustrated in FIG. 5, the heating unit 200 may include an insulated mounting pad 201, e.g., by which the heating element 204 is mounted in the frame 202. The insulated mounting pad 201 is thermally insulated. For example, the frame 202 may be made of a heat-sensitive material such as a plastic material, or a material having a distinct coefficient of thermal expansion from the heating element 204, and the thermally insulated mounting pad 201 may prevent or reduce thermal transfer from the heating element 204 to the frame 202.

Figure 6:
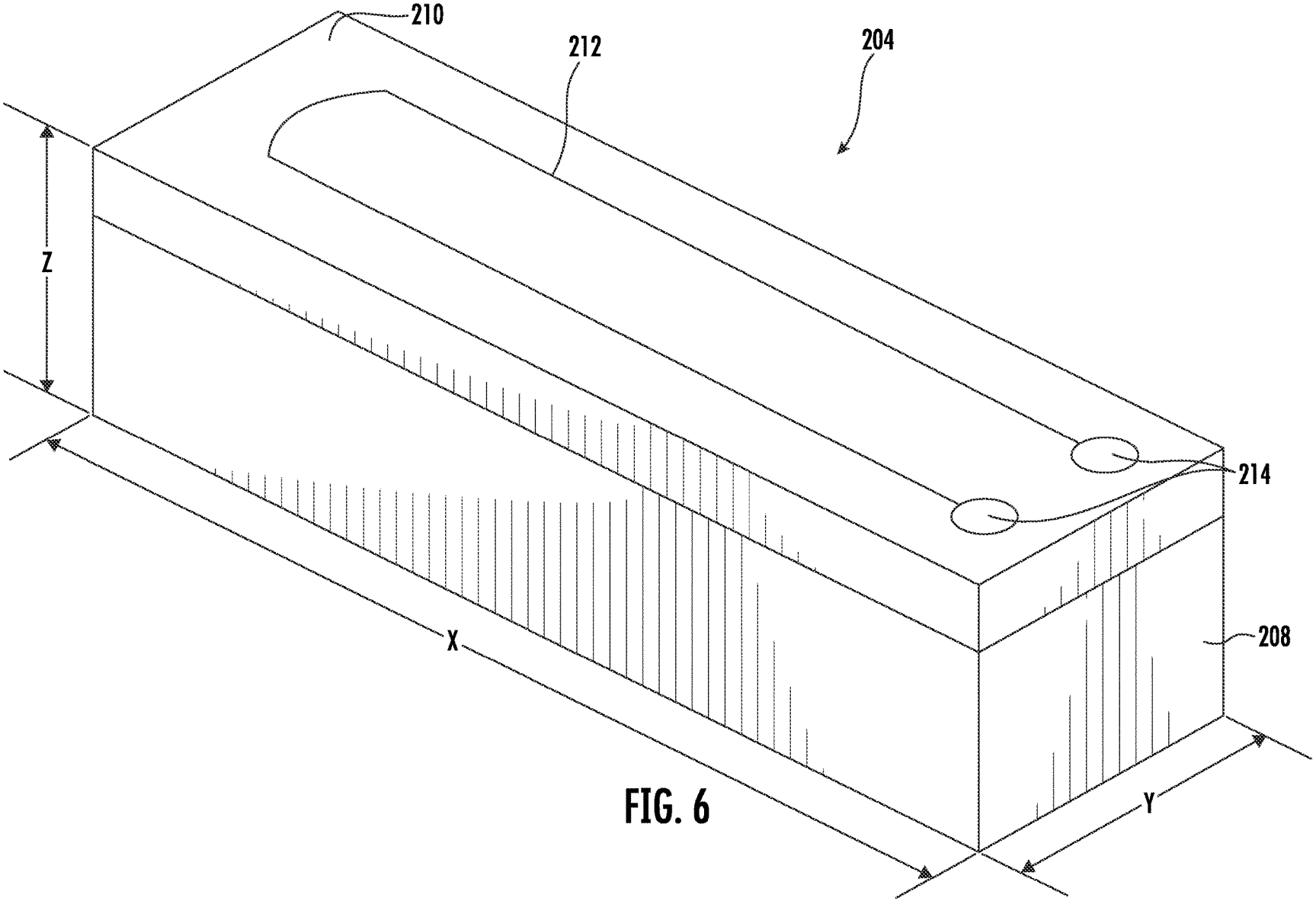
FIG. 6 provides a perspective view of an exemplary heating element in accordance with one or more exemplary embodiments of the present disclosure.

Turning now to FIG. 6, a perspective view of an exemplary strip heating element 204, which may be the heating element 204 of the heating unit 200 or one of the heating elements 204 of the heating unit 200 in various embodiments, is provided. As may be seen, e.g., in FIG. 6, the strip heating element 204 is referred to as a "strip" heating element 204 because the geometry of the heating element is generally an elongated rectangular prism, e.g., where a length X, e.g., longest dimension, of the strip heating element 204 is several times larger than every other dimension of the heating element 204. For example, as illustrated in FIG. 6, length X is several times larger than width Y and is several times larger than height Z.

As may be seen in FIG. 6, the strip heating element 204 may include a substrate 208 and a film 210 on the substrate 208. The film 210 may be printed on the substrate 208 or otherwise bonded to the substrate 208, such as on a surface of the substrate 208, e.g., an external surface of the substrate 208. The substrate 208 may include a ceramic material, a metal material, a plastic material, or other suitable material. In at least some embodiments, the substrate 208 may comprise a material having the same or generally the same coefficient of thermal expansion as the film material. The film 210 may be a thick film. For example, the film 210 may be "thick" in that the film 210 has a macroscopic thickness, e.g., along the direction of the height Z of the strip heating element 204, such as a thickness that is visible to the naked eye, such as a thickness of at least fifty microns (50 μm). The substrate 208 may provide strength and structural stability to the film 210.

The film 210 includes electrically conductive materials and electrically non-conductive materials, which are arranged and configured to form resistance heating circuits in the film 210. For example, the film 210 may include printed electrically conductive material, e.g., conductive ink, embedded in the film 210 which forms a resistance heating coil 212. For example, the heating coil 212 may be a single loop, e.g., as illustrated in FIG. 6. A terminal 214 may be formed at each end of the heating coil 212, e.g., for connecting to a power supply, such as a relay (see, e.g., FIG. 10). Further, the strip heating element 204 may also include an electrically insulative coating on top of the film 210.

Figure 7:
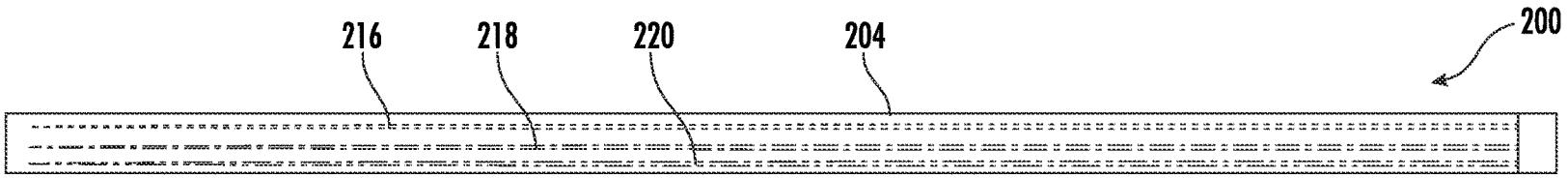
FIG. 7 provides a top view of a single strip heating element having multiple heating coils, in accordance with one or more exemplary embodiments of the present disclosure.
Figure 8:
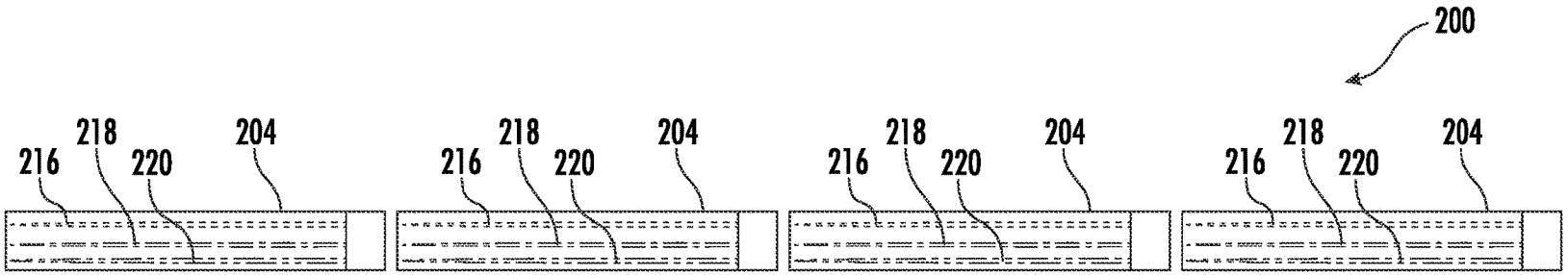
FIG. 8 provides a top view of multiple strip heating elements in a longitudinal array, where each strip heating element includes multiple heating coils, in accordance with one or more exemplary embodiments of the present disclosure.
Figure 9:
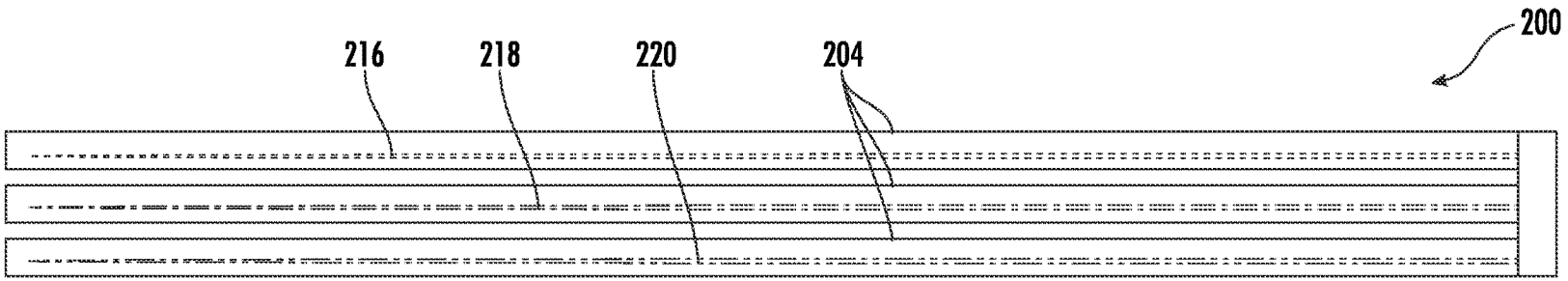
FIG. 9 provides a top view of multiple strip heating elements aligned generally mutually parallel to each other, where each strip heating element includes a single heating coil, in accordance with one or more exemplary embodiments of the present disclosure.

Turning now to FIGS. 7 through 9, in various embodiments, the heating unit 200 may include one or more strip heating element 204, and the heating element 204 or each heating element 204 may include one or more heating coils 216, 218, and/or 220 therein. It is to be understood that the exemplary heating coil 212 of FIG. 6 may be any one or more of the heating coils 216, 218, and/or 220 described in the context of FIGS. 7 through 9, such as all of the heating coils 216, 218, and 220 may be formed as illustrated in FIG. 6.

As illustrated in FIG. 7, in some embodiments, the heating unit 200 may include only a single strip heating element 204. In additional embodiments, the heating unit 200 may include multiple heating elements 204, e.g., as illustrated in FIG. 8 and FIG. 9. For example, the multiple heating elements 204 may be aligned along a common axis, e.g., the heating elements 204 in the heating unit 200 may all be colinear or generally colinear, as illustrated in FIG. 8. As another example, e.g., as illustrated in FIG. 9, the multiple heating elements 204 of the heating unit 200 may be parallel or generally parallel to each other.

The heating unit 200 is generally configured to provide variable heat output, such as based on or in response to a call for heating, a difference between a set temperature and an actual temperature, or a user-selected heating level such as high, medium, or low heat, etc. Such variable heating may be provided by multiple heating coils 216, 218, and/or 220 with different wattages in the heating unit 200, whereby one or more selected heating coils 216, 218, and/or 220 may be activated at a time in order to provide the desired level of heating. The multiple heating coils in the heating unit 200 may all be provided in a single strip heating element 204 or may be divided amongst multiple heating elements 204. For example, the heating unit 200 may include a first heating coil 216, which may be a low heating coil, a second heating coil 218, which may be a high heating coil, and a third heating coil 220, which may be a medium heating coil. The low heating coil may be, e.g., about 1000 Watts, the high heating coil 218 may be, e.g., about 2400 Watts, and the medium heating coil 220 may be, e.g., about 1400 Watts.

In some embodiments, e.g., as illustrated in FIG. 7, each of the three heating coils 216, 218, and 220 may be formed in a single strip heating element 204 of the heating unit 200. As illustrated in FIG. 8, in additional embodiments, the high, low, and medium heating coils may all be collectively provided in multiple strip heating elements 204 of the heating unit 200, where each strip heating unit 204 contains a portion of each heating coil. For example, as illustrated in FIG. 8, the heating unit 200 may include multiple strip heating elements 204, e.g., four strip heating elements 204, each of which includes a first heating coil 216, and the first heating coils 216 of the multiple, e.g., four, heating elements 204 may collectively provide low heating, e.g., about 1000 Watts. For example, each first heating coil 216 of the four strip heating elements 204 may be one-fourth of the low heating level, e.g., about 250 Watts, whereby all four heating elements 204 of the heating unit 200 in the embodiment illustrated in FIG. 8 collectively provide low heat, e.g., about 1000 Watts, when the four first heating coils 216 of the four heating elements 204 are activated. Continuing the example, the four second heating coils 218 of the four heating elements 204 for the heating unit 200 illustrated in FIG. 8 may each be about 600 Watts and collectively about 2400 Watts, while the four third heating coils 220 may each be about 350 Watts and collectively about 1400 Watts. In further embodiments, two or three strip heating elements 204 may be provided in the heating unit 200, or more than four strip heating elements 204 may be provided, wherein the multiple strip heating elements 204 collectively provide any desired heating level, as discussed above. In additional exemplary embodiments, e.g., as illustrated in FIG. 9, the heating unit 200 may include multiple heating elements 204, e.g., three strip heating elements 204, and each heating element 204 may have a single one of the three heating coils 216, 218, and 220 formed therein. In still further exemplary embodiments, combinations of the foregoing arrangements may be provided, such as two heating elements 204 with two heating coils each, or one single heating coil in one heating element 204 while another heating element 204 in the same heating unit 200 includes more than one heating coil, among other possible variations and combinations.

Figure 10:
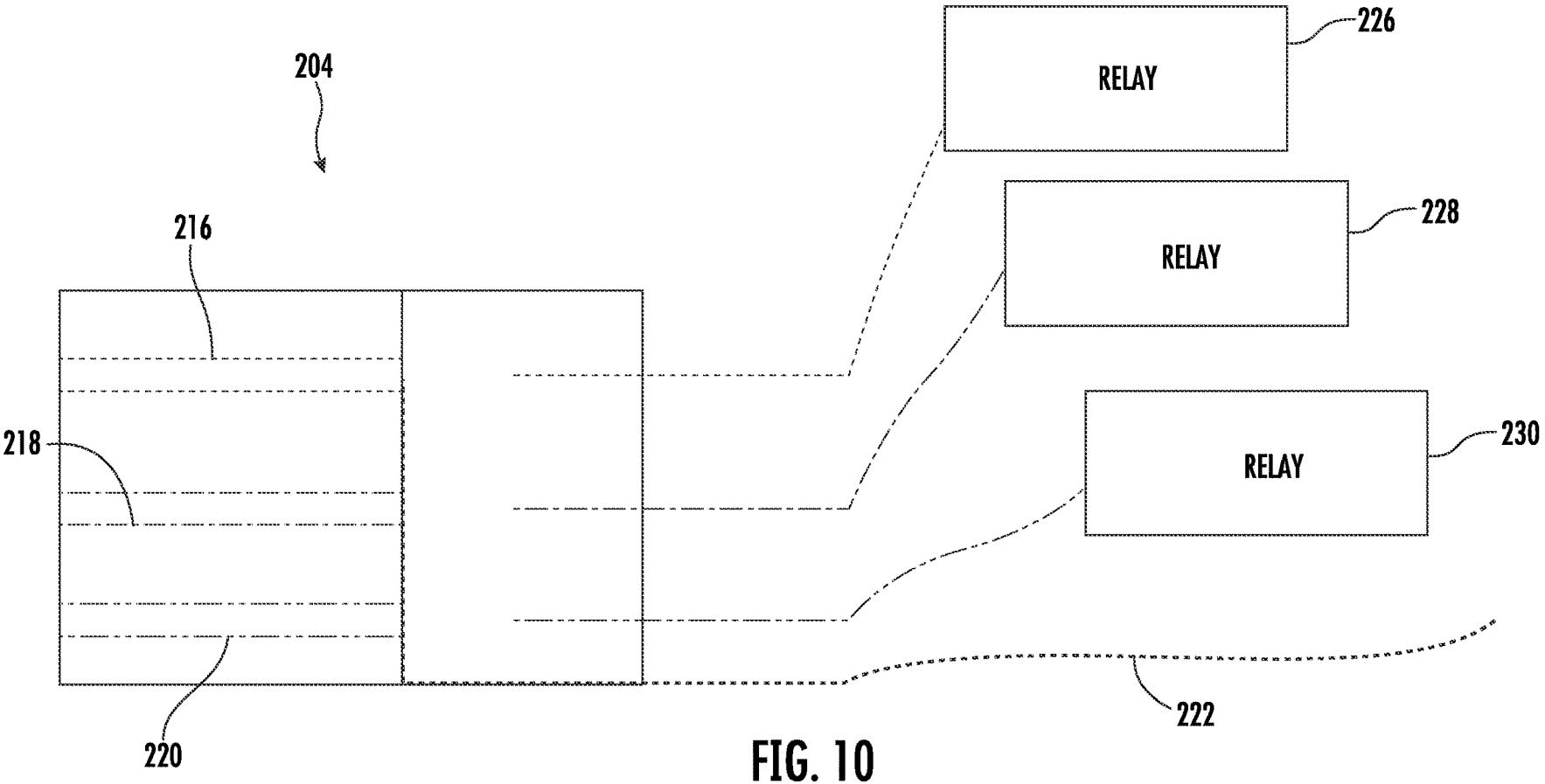
FIG. 10 provides an enlarged view of a portion of a heating element and electrical connections for the heating element, in accordance with one or more exemplary embodiments of the present disclosure.

FIG. 10 provides an enlarged view of a portion of one strip heating element 204, which may one of multiple heating elements 204 in a heating unit 200, or which may be the only heating element 204 of a heating unit 200. In particular, FIG. 10 illustrates electrical connections for the heating coils 216, 218, and 220 in the exemplary heating element 204. It is to be understood that the heating coils 216, 218, and 220 illustrated in FIG. 10 also include terminals 214 (FIG. 6) at each end of each coil, although the terminals are not specifically illustrated in FIG. 10 for the sake of clarity. As illustrated in FIG. 10, each heating coil may be coupled to a respective relay to provide electrical power, e.g., the corresponding wattages described above, to the heating coils 216, 218, and 220. More specifically, a first relay 226 may be coupled to the first heating coil 216 and may provide a first wattage to the first heating coil 216. In turn, a second relay 228 may be coupled to the second heating coil 218 and may provide a second wattage to the second heating coil 218, and a third relay 230 may be coupled to the third heating coil 220 and may provide a third wattage to the third heating coil 220. Furthermore, each heating coil may be coupled to a common ground or lead wire 222.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

an indoor heat exchanger assembly positioned in an indoor portion of the air conditioner unit, the indoor heat exchanger assembly comprising an indoor heat exchanger and an indoor fan; and a strip heating element positioned in the indoor portion of the air conditioner unit downstream of the indoor fan, the strip heating element comprising a substrate and a film printed on an external surface of the substrate, the film comprising conductive ink embedded in the film, the conductive ink forming a resistance heating coil of the strip heating element.

2. The air conditioner unit of claim 1, wherein the strip heating element is the only heating element in the indoor portion of the air conditioner unit.

3. The air conditioner unit of claim 1, wherein there is no heating element upstream of the indoor fan.

4. The air conditioner unit of claim 1, wherein the resistance heating coil is the only heating coil in the strip heating element.

5. The air conditioner unit of claim 1, wherein the conductive ink embedded in the film forms a plurality of resistance heating coils.

6. The air conditioner unit of claim 1, further comprising an outdoor heat exchanger assembly positioned in an outdoor portion of the air conditioner unit, the outdoor heat exchanger assembly comprising an outdoor heat exchanger and an outdoor fan, the air conditioner unit further comprising a bulkhead positioned between the outdoor portion and the indoor portion whereby the bulkhead separates the indoor portion and the outdoor portion and the bulkhead partially defines each of the indoor portion and the outdoor portion, wherein the strip heating element is mounted to the bulkhead.

7. The air conditioner unit of claim 6, wherein the strip heating element is positioned in an insert received within the bulkhead, further comprising a thermally insulative mounting pad in the insert.

8. The air conditioner unit of claim 7, wherein the bulkhead is positioned between the indoor portion and the outdoor portion along a transverse direction, and wherein the strip heating element is generally coextensive with the indoor fan along a lateral direction perpendicular to the transverse direction.

9. The air conditioner unit of claim 1, further comprising a thermal cutout in thermal communication with the strip heating element, the thermal cutout configured to deactivate the strip heating element when a temperature at the thermal cutout exceeds a threshold.

10. An air conditioner unit, comprising:

an indoor heat exchanger assembly positioned in an indoor portion of the air conditioner unit, the indoor heat exchanger assembly comprising an indoor heat exchanger and an indoor fan, the indoor fan defining a suction side and an exhaust side;

an outdoor heat exchanger assembly positioned in an outdoor portion of the air conditioner unit, the outdoor heat exchanger assembly comprising an outdoor heat exchanger and an outdoor fan;

a bulkhead positioned between the outdoor portion and the indoor portion whereby the bulkhead separates the indoor portion and the outdoor portion and the bulkhead partially defines each of the indoor portion and the outdoor portion; and a heating element mounted to the bulkhead and positioned in the indoor portion of the air conditioner unit at the exhaust side of the indoor fan, wherein the heating element is positioned in an insert received within the bulkhead, the air conditioner unit further comprising a thermally insulative mounting pad in the insert.

11. The air conditioner unit of claim 10, wherein the heating element is the only heating element in the indoor portion of the air conditioner unit.

12. The air conditioner unit of claim 10, wherein there is no heating element on the suction side of the indoor fan.

13. The air conditioner unit of claim 10, wherein the heating element comprises a substrate and a film printed on an external surface of the substrate, the film comprising conductive ink embedded in the film, the conductive ink forming a resistance heating coil of the heating element.

14. The air conditioner unit of claim 13, wherein the resistance heating coil is the only heating coil in the heating element.

15. The air conditioner unit of claim 13, wherein the conductive ink embedded in the film forms a plurality of resistance heating coils.

16. The air conditioner unit of claim 10, wherein the bulkhead is positioned between the indoor portion and the outdoor portion along a transverse direction, and wherein the heating element is generally coextensive with the indoor fan along a lateral direction perpendicular to the transverse direction.

17. The air conditioner unit of claim 10, further comprising a thermal cutout in thermal communication with the heating element, the thermal cutout configured to deactivate the heating element when a temperature at the thermal cutout exceeds a threshold.

18. An air conditioner unit, comprising:

an indoor heat exchanger assembly positioned in an indoor portion of the air conditioner unit, the indoor heat exchanger assembly comprising an indoor heat exchanger and an indoor fan, the indoor fan defining a suction side and an exhaust side; and a heating element positioned in the indoor portion of the air conditioner unit at the exhaust side of the indoor fan, the heating element comprising a substrate and a film printed on an external surface of the substrate, the film comprising conductive ink embedded in the film, the conductive ink forming a resistance heating coil of the heating element.

19. The air conditioning unit of claim 18, wherein the resistance heating coil is the only heating coil in the heating element.

20. The air conditioning unit of claim 18, wherein the conductive ink embedded in the film forms a plurality of resistance heating coils.

* * * * *